US008622015B1

(12) United States Patent
Snyder

(10) Patent No.: US 8,622,015 B1
(45) Date of Patent: Jan. 7, 2014

(54) RUN/WALK WITH VISIBLE PROGRESS MARKING

(71) Applicant: Travis L. Snyder, South Jordan, UT (US)

(72) Inventor: Travis L. Snyder, South Jordan, UT (US)

( * ) Notice: Subject to any disclaimer, the term of this patent is extended or adjusted under 35 U.S.C. 154(b) by 0 days.

(21) Appl. No.: 14/010,932

(22) Filed: Aug. 27, 2013

Related U.S. Application Data

(60) Provisional application No. 61/738,176, filed on Dec. 17, 2012.

(51) Int. Cl.
*G09F 21/02* (2006.01)

(52) U.S. Cl.
USPC ..... 116/201; 116/200; 472/133

(58) Field of Classification Search
USPC ..... 116/200, 201, 209; 40/300, 326, 584, 40/586, 612; 102/498, 513; 273/444, 445; 434/84, 255; 446/26, 27, 28; 463/59, 463/60; 472/52, 53, 85, 133, 137; 482/14
See application file for complete search history.

(56) References Cited

U.S. PATENT DOCUMENTS

| | | | | |
|---|---|---|---|---|
| 2,199,093 | A | 4/1940 | Wolfenden | |
| 4,541,402 | A * | 9/1985 | Winters | 124/27 |
| 5,288,322 | A | 2/1994 | Hanna et al. | |
| 5,549,933 | A * | 8/1996 | Adams et al. | 434/84 |
| 5,678,730 | A * | 10/1997 | Fabek et al. | 222/78 |
| 6,199,311 | B1 * | 3/2001 | Foster | 43/1 |
| 6,964,229 | B1 * | 11/2005 | Zimmerman | 101/483 |
| 7,444,938 | B2 * | 11/2008 | Tippmann | 102/498 |
| 7,725,955 | B1 * | 6/2010 | Johnson | 2/115 |
| 8,142,197 | B2 * | 3/2012 | Tucker | 434/255 |
| 8,206,057 | B2 * | 6/2012 | Setzer et al. | 404/9 |
| 8,322,059 | B2 * | 12/2012 | Henshaw | 40/586 |
| 8,409,301 | B1 | 4/2013 | Ackerman | |
| 2001/0047951 | A1 * | 12/2001 | O'Connor | 206/575 |
| 2005/0055274 | A1 * | 3/2005 | Leb | 705/14 |
| 2006/0236914 | A1 * | 10/2006 | Willett | 116/209 |

(Continued)

FOREIGN PATENT DOCUMENTS

| | | | | |
|---|---|---|---|---|
| DE | 3117044 | A1 * | 11/1982 | E01F 15/00 |
| JP | 05249898 | A * | 9/1993 | G09F 7/00 |

OTHER PUBLICATIONS

"Color Me Rad 5K—Frequently Asked Questions" webpage as printed from the internet on Nov. 7, 2013, 7 pages.*

(Continued)

*Primary Examiner* — R. A. Smith
(74) *Attorney, Agent, or Firm* — John R. Thompson; Stoel Rives LLP

(57) ABSTRACT

A run/walk may include visible progress marking of participants. The run/walk may be marked including marking one or more color zones and marking a start line and a finish line. A start to the run/walk may be signaled. The participants may traverse the run/walk including traversing the color zones. At each color zone, a quantity of a colored substance may be propelled at the participants as they traverse the color zone. Each color zone may be associated with a color, and colored substance propelled at the participants in each color zone may include the associated color. After the run/walk is complete, markings for the run/walk may be removed. An article of clothing may include the visible progress markings after receiving the propelled quantity of the colored substance. The markings may be preserved on the article of clothing by adding vinegar and hot pressing the article of clothing.

24 Claims, 4 Drawing Sheets

(56) References Cited

U.S. PATENT DOCUMENTS

| | | | | |
|---|---|---|---|---|
| 2008/0220398 | A1* | 9/2008 | Dendooven | 434/84 |
| 2009/0095177 | A1* | 4/2009 | Fields et al. | 101/127.1 |
| 2013/0117910 | A1* | 5/2013 | Snyder | 2/244 |

OTHER PUBLICATIONS

"The Color Run™—About Us" webpage as printed from the internet on Nov. 12, 2013, 2 pages.*

Stephens, Karen, "Color Me Rad 5K Comes to Hartford—May 26," published in the Connecticut Weekender on May 8, 2012, accessed online at http://ctweekender.com/2012/05/color-me-rad-5k-comes-to-hartford-may-26/, 3 pgs.

"How to Dye Fabric with Natural Dyes" published on Earth Divas' Blog on Jul. 13, 2010, accessed online at http://earthdivasblog.com/2010/07/13/how-to-dye-fabric-with-natural-dyes/, 2 pgs.

Karkabi, Barbara, "Festival of Colors," (relevance, paragraph 4), The Houston Chronicle, Mar. 7, 2009, Religion Section, 2 pgs.

Kelso, John, "Not the best time to sprinkle white powder," The Gazette (Montreal, Quebec), Nov. 1, 2001 (relevance full text paragraph 12), 3 pgs.

* cited by examiner

RUN/WALK WITH VISIBLE PROGRESS MARKING

RELATED APPLICATION

This application claims priority to U.S. Patent Application Ser. No. 61/738,176 filed on Dec. 17, 2012, and entitled "RUN/WALK WITH VISIBLE PROGRESS MARKING."

TECHNICAL FIELD

This application relates to methods for conducting run/walks with visible progress marking of the participants.

DETAILED DESCRIPTION OF PREFERRED EMBODIMENTS

Running has grown in popularity due to its health benefits and the positive feelings that it can generate. Many races of various lengths are held throughout the world. Races may include a plurality of participants, which can add a communal feeling and further enhance the joy brought from running. However, many people choose to forgo participating in races because they find them boring, unmemorable, and/or tedious, and/or they do not enjoy the competitiveness of timed races. A race may be made more memorable, interesting, and fun by creating a custom article of clothing during the race that will remind the participant of the race.

Figure 1:
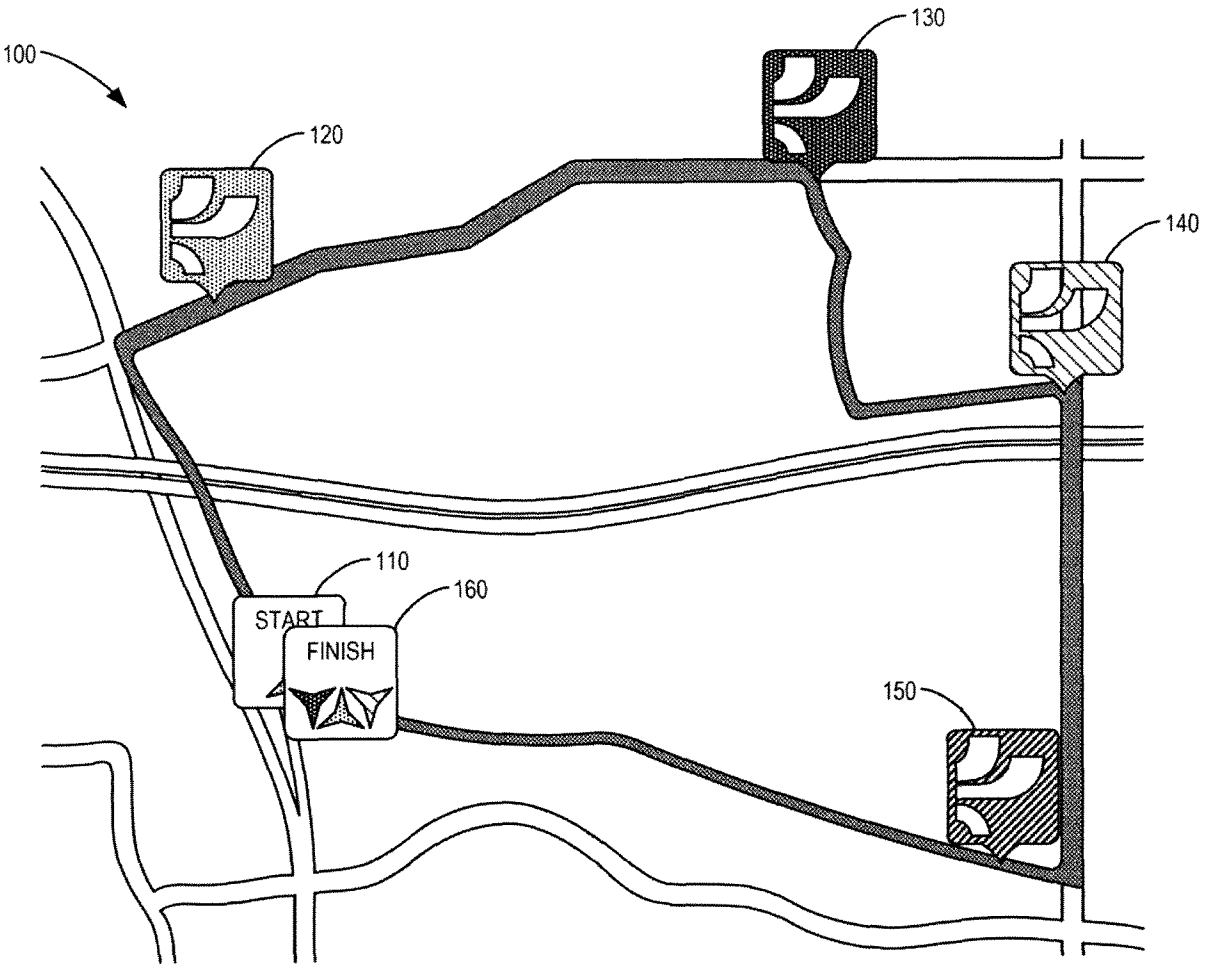
FIG. 1 is a schematic view of a run/walk course with visible progress marking of participants.

FIG. 1 is a schematic view of a run/walk course 100 with visible progress marking of participants. A run/walk may be a timed race, an untimed traversing of a marked course, and/or the like. The run/walk may also be called a paint race even if no official time is kept for the event and/or no winner is declared. Visible progress marking of participants as they traverse the course 100 may enjoyably divert participants attention and make the run/walk less tedious and/or boring for the participants. Additionally, the visible progress markings may stylize and/or color one or more articles of clothing with unique markings indicative of experiences of a participant during and after traversal of the course. The participant can save the article as a reminder of the indicated experiences, which the participant may recall with fondness when reminded of the experiences. The visible progress markings may transform an unadorned article of clothing to an article of clothing with a plurality of indications of a plurality of corresponding events enjoyed by the participant. Alternatively or in addition, the visible progress markings may indicate a number of race segments completed by the participant.

A run/walk course 100 may be set up by marking the course 100. Marking the course may include placing an indication of a start line 110 at a course start area and placing an indication of a finish line 160 at a course finish area. The start and/or finish line 110, 160 may include a tape or ribbon, markings on the ground, boxes, signs, banners, balloons, and/or the like. The course 100 may be a predetermined path from the start line 110 to the finish line 160 that participants will traverse during the run/walk. One or more color zones 120, 130, 140, 150 may be set up and/or marked along the course 100. The color zones 120, 130, 140, 150 may also be referred to as color stations. In some embodiments, the course finish area or the finish line 160 and/or the course start area or the course start line 110 may include a color zone 120, 130, 140, 150. Alternatively, or in addition, a color zone 120, 130, 140, 150 may be situated at, just before, or just after the course start line 110 and/or the course finish line 160. The participant may traverse each color zone 120, 130, 140, 150 while traversing the course 100.

A section of the course 100 between the start line 110 and the first color zone 120, between the fourth color zone 150 and the finish line 160, and/or between adjacent color zones 120, 130, 140, 150 may be referred to as a race segment. The term adjacent may refer to two color zones 120, 130, 140, 150 that can be traversed by the participant sequentially when traversing the course 100 without any other color zone 120, 130, 140, 150 being traversed between them. A course length between the start line 110 and the finish line 160 may substantially equal three, five, or ten kilometers or miles in some embodiments and/or the like. A course distance of a race segment may substantially equal one kilometer, one half of a kilometer, one half of a mile, one mile, and/or the like. A distance may substantially equal another distance if the difference is no more than 1 meter, 5 meters, 10 meters, 50 meters, 100 meters, 400 meters, or the like. Race segments may have uniform and/or non-uniform course distances relative to one another. The course 100 may have one or more turns and/or a same geographic area may be traversed multiple times when the course 100 is traversed. The course 100 may include first and second sides of a road that are traversed in opposite direction. A course length and/or a course distance may refer to the distance travelled by the participant when traversing the course 100. The shortest distance between two points on the course 100, which may include a path that leaves the course 100, may be referred to as the absolute distance.

Figure 2:
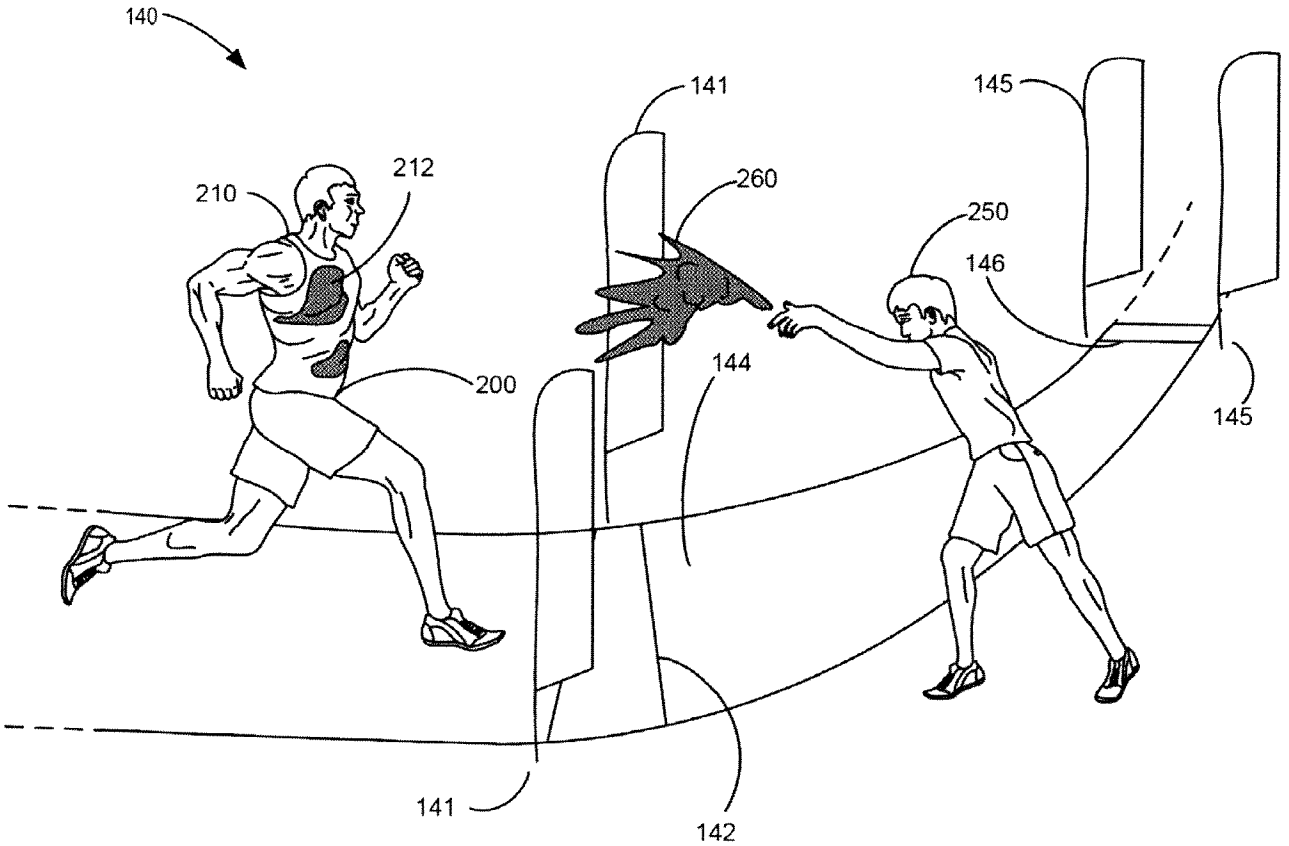
FIG. 2 is an exploded view of the third color zone as it is traversed by a first participant.

FIG. 2 is an exploded view of the third color zone 140 as it is traversed by a first participant 200. The first participant 200 may traverse the third color zone 140, including traversing a color start area 142 and a color finish area 146, while traversing the course 100. The third color zone 140 may be marked with a plurality banners or the like, such as a plurality of feather-shaped flag banners 141, 145. The plurality of feather-shaped flag banners 141, 145 may alert the first participant to the location of the third color zone 140 and/or the color being dispersed at the third color zone 140. The color starting area 142 may be marked with a first pair of feather-shaped flag banners 141 on the sides of the course 100. The color finish area 146 may be marked with a second pair of feather-shaped flag banners 145 on the sides of the course 100. Additional feather-shaped flag banners (not shown) may be placed along an intermediate region 144, such as on the side of the course 100 and/or more than one pair of feather-shaped flag banners may be at the start area 142 and/or the finish area 146.

Each color zone 120, 130, 140, 150 may be associated with one or more unique colors (e.g., an associated color) different from the colors associated with the other color zones 120, 130, 140, 150. Each color zone 120, 130, 140, 150 may be marked with a corresponding plurality of identically colored feather-shaped flag banners 141, 145 including the associated color. For example, the first color zone 120 may be yellow and have banners including the color yellow, the second color zone 130 may be green and have banners including the color green, the third color zone 140 may be blue and have banners including the color blue, the fourth color zone 150 may be purple and have banners including the color purple, and a color zone at the course finish area and/or finish line 160 may be pink and have banners including the color pink. The colors may include pink, purple, yellow, green, blue, orange, red, and/or the like. Two colors may be considered similar, the same, and/or identical despite variations in color appearance, such as variations in brightness, lightness, colorfulness, chroma, saturation, tint, shade, tone, hue, and/or the like (e.g., red may include dark red, light red, fire-engine red, and the like), and/or two colors with differences in color appearance may be considered different colors (e.g., red and pink). The choice of color definition may vary between embodiments.

While the first participant 200 traverses the third color zone 140, a first quantity of a colored substance 260 may be propelled at the first participant 200 by a color disperser 250. In some embodiments, a plurality of color dispersers may be positioned on each side of the third color zone 140 to increase the number of participants that can receive the colored substance at one time while traversing the third color zone (e.g., to increase the crowd flow rate). Propelling the first quantity of the colored substance 260 at the first participant 200 may include propelling the first quantity of the colored substance 260 at an article of clothing 210 worn by the first participant 200. The article of clothing 210 may be a t-shirt, a tank top, shorts, knee socks, shoes, a hat, sunglasses, a bandana, a sweatshirt, pants, a wristband, a headband, and/or the like. The first participant 200 may receive the first propelled quantity of the colored substance 260 on the article of clothing 210. Upon receiving the first quantity of the colored substance 260, the first participant 200 and/or the article of clothing 210 may be stained by the colored substance, which may result in one or more visible markings 212 on the first participant 200.

The first quantity of the color substance 260 may be propelled at the first participant 200 by throwing the colored substance at the first participant 200, jetting or ejecting the first quantity of the colored substance from a nozzle, and/or the like. For example, a nozzle may be attached to a container, such as an elastically deformable container, holding the colored substance, and the colored substance may be ejected by applying pressure to the container (e.g., squeezing the container). Alternatively, or in addition, a manual or automatic pump, hydraulic pressure, and/or the like may be used to jet or eject the colored substance from the nozzle. A substance configured to stimulate senses other than sight may be used in addition to or instead of the colored substance, such as a substance with a fragrance and/or odor, a substance configured to create a tactile stimulus, and/or the like. Music and/or other sounds may be played within an audible distance of each color zone and/or within an audible distance of the finish area and/or a course finishing point. Light or visual stimuli other than the colored substance and banners 141, 145 may be used to visually stimulate the first participant 200 at each color zone in an embodiment.

For each color zone 120, 130, 140, 150, the colored substance propelled in that color zone 120, 130, 140, 150 may comprise a similar color to the color associated with that color zone 120, 130, 140, 150. For example, if the first color zone 120 is associated with the color yellow and the second color zone 130 is associated with the color green, the first quantity of the colored substance 260 propelled at the first participant 200 in the first color zone 120 may be yellow and a second quantity of the colored substance propelled at the first participant 200 while the first participant 200 traverses the second color zone 130 may be green. The colored substance and the plurality of feather-shaped flag banners 141, 145 may also include similar colors.

Figure 3:
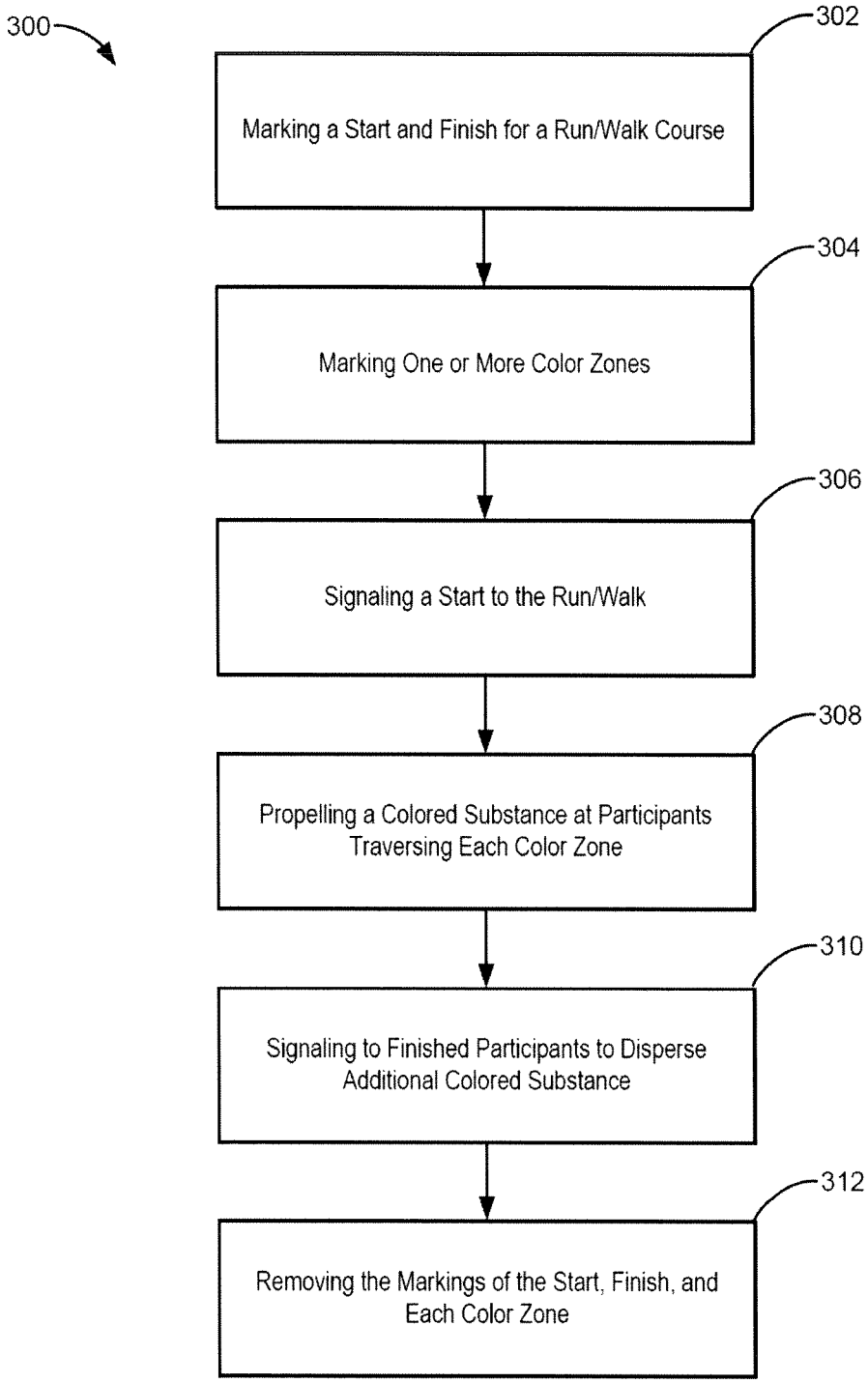
FIG. 3 is a flow diagram of a method for conducting a run/walk with visible progress marking.

FIG. 3 is a flow diagram of a method 300 for conducting a run/walk with visible progress marking. Conducting the run/walk may include marking 302 a start and a finish for a run/walk course 100. Marking the start may include placing an indication of a start line 110, such as using a tape or ribbon, markings on the ground, boxes, signs, balloons, banners (e.g., feather-shaped flag banners, which may include the word "Start"), inflatable structures, and/or the like. Additionally, marking the start may include placing barriers, such as metal crowd control barriers, cones, tape or ribbon, and/or the like, to corral participants in a course starting area. Marking the finish may include placing an indication of a finish line 160, such as using a tape or ribbon, markings on the ground, boxes, signs, balloons, banners (e.g., feather-shaped flag banners, which may include the word "Finish"), inflatable structures, and/or the like. Marking the finish may include placing barriers; setting up water stations for the distribution of water; setting up bathrooms; setting up a platform, stage, or the like from which sound is projected (e.g., music and/or announcements); setting up a colored substance distribution station for distributing the colored substance for later dispersal; and/or the like.

Conducting the run/walk may include marking 304 one or more color zones 120, 130, 140, 150 along the run/walk course 100. Marking 304 the one or more color zones 120, 130, 140, 150 may include setting up a plurality of feather-shaped flag banners 141, 145 at each color zone 120, 130, 140, 150. Marking 304 the one or more color zones 120,130, 140, 150 may include marking a color start area and/or marking a color finish area for each color zone 120, 130, 140, 150. The colored substance may also be placed at each color zone 120, 130, 140, 150 so that the colored substance can be dispersed at participants. The same type of colored substance may be used at each color zone 120, 130, 140, 150, or different types of colored substance may be used at each color zone 120, 130, 140, 150 (e.g., a colored power at the first color zone 120 and a colored liquid at the second color zone 130).

The feather-shaped flag banners 141, 145 and/or the colored substance set up at a particular color zone may be similar to or the same as one or more colors associated with that particular color zone. Alternatively, or in addition, the feather-shaped flag banners 141, 145 may include text, a logo for the race, and/or a plurality of colors. Marking 304 the one or more color zones 120, 130, 140, 150 may also include setting up water stations at one or more of the color zones 120, 130, 140, 150. The water stations may be at the color zones 120, 130, 140, 150, and/or the water stations may be a short distance before or after the color zones 120, 130, 140, 150. Alternatively, the water stations may be set up separate from the color zones 120, 130, 140, 150. The water stations may include water than can be taken by the participants (e.g., personal-sized water bottles). The water stations may include tables or the like to hold the water at a convenient height. Signs, cones, barriers, and/or the like may be marked and/or set up along the run/walk course 100 to direct participants traversing the run/walk course 100.

Traversal of the run/walk by participants may begin with signaling 306 a start to the run/walk. Signaling may include emitting a first audible signal, displaying a visible signal, and/or the like. Examples of audible signals may include a gunshot, a horn blast, a tone, a vocal utterance, and/or the like. The audible signal may be digital and/or produced by a computer processor. The participants may receive the start signal and begin traversing the course 100 after the start signal is received. The participant may traverse the course, including crossing the start line 110, traversing through the plurality of color zones 120, 130, 140, 150, and crossing the finish line 160. In an embodiment, the participants may be divided into a plurality of groups with different start times. Thus, signaling 306 a start may include signaling the start to each group at their corresponding start time, specifying which group is starting, and/or the like.

After the first participant 200 completes each race segment, the participant 200 may traverse a corresponding color zone 120, 130, 140, 150. Quantities of a colored substance may be propelled 308 at the participants as each color zone 120, 130, 140, 150 is traversed. For example, while the first participant 200 traverses the first color zone 120, a first quantity of a colored substance 260 may be propelled at the participant 200. The first quantity of the colored substance 260 may be configured to additionally disperse onto other participants when propelled at the first participant 200. The first quantity of the colored substance 260 may additionally disperse onto other participants by scattering into the air due to the propulsion and/or due to rebounding off the first participant 200 and landing on the other participants. The colored substance may include a powder, a liquid, an aerosol, and/or the like. In an embodiment, the colored substance may include dyed cornstarch as a powder and/or dissolved in liquid.

Additional activities may be conducted near the finish area. The additional activities may include selling items to the finished participants, color tosses (also referred to as color throws) at regular intervals (e.g., every fifteen minutes), playing music to entertain finished participants and to encourage them to remain at the finish area, a dance party, dance-offs, free giveaways of items and/or the like. The sold items may include t-shirts, tank tops, shorts, knee socks, hats, sunglasses, bandanas, sweatshirts, pants, wristbands, headbands, color packets containing the colored substance, and/or the like. The color tosses may include signaling 310 to a plurality of finished participants at the regular intervals that additional quantities of the colored substance should be dispersed into the air. The finished participants may disperse the additional quantities after receiving the signal. The finished participants may receive the additional quantities of the colored substance dispersed into the air, which may create additional visible markings 212 on the finished participants. The finished participants may throw the additional quantities of the colored substance up into the air to disperse the additional quantities. Signaling at regular intervals may include emitting a second audible signal at the regular intervals, such as a vocal utterance. The second audible signal may vary between the emissions at the regular intervals. The additional quantities may be a uniform color, and/or the additional quantities may include a plurality of colors.

After the participants have finished traversing the run/walk course and/or have finished any post-race activities, the course 100 and/or the color stations 120, 130, 140, 150 may be cleaned up. Cleaning up may include removing 312 the markings of the start line 110, the finish line 160, and/or each color zone 120, 130, 140, 150, such as removing indications of the start, indications of the finish, barriers, water stations, bathrooms, platforms, stages, colored substance distribution stations, the plurality of feather-shaped flag banners 141, 145, any remaining quantities of colored substance at each color zone 120, 130, 140, 150, trash, and/or the like. In an embodiment, the markings of the start line 110, the finish line 160, and/or each color zone 120, 130, 140, 150 may be reused to perform the method again in the future, such as at another location.

Figure 4:
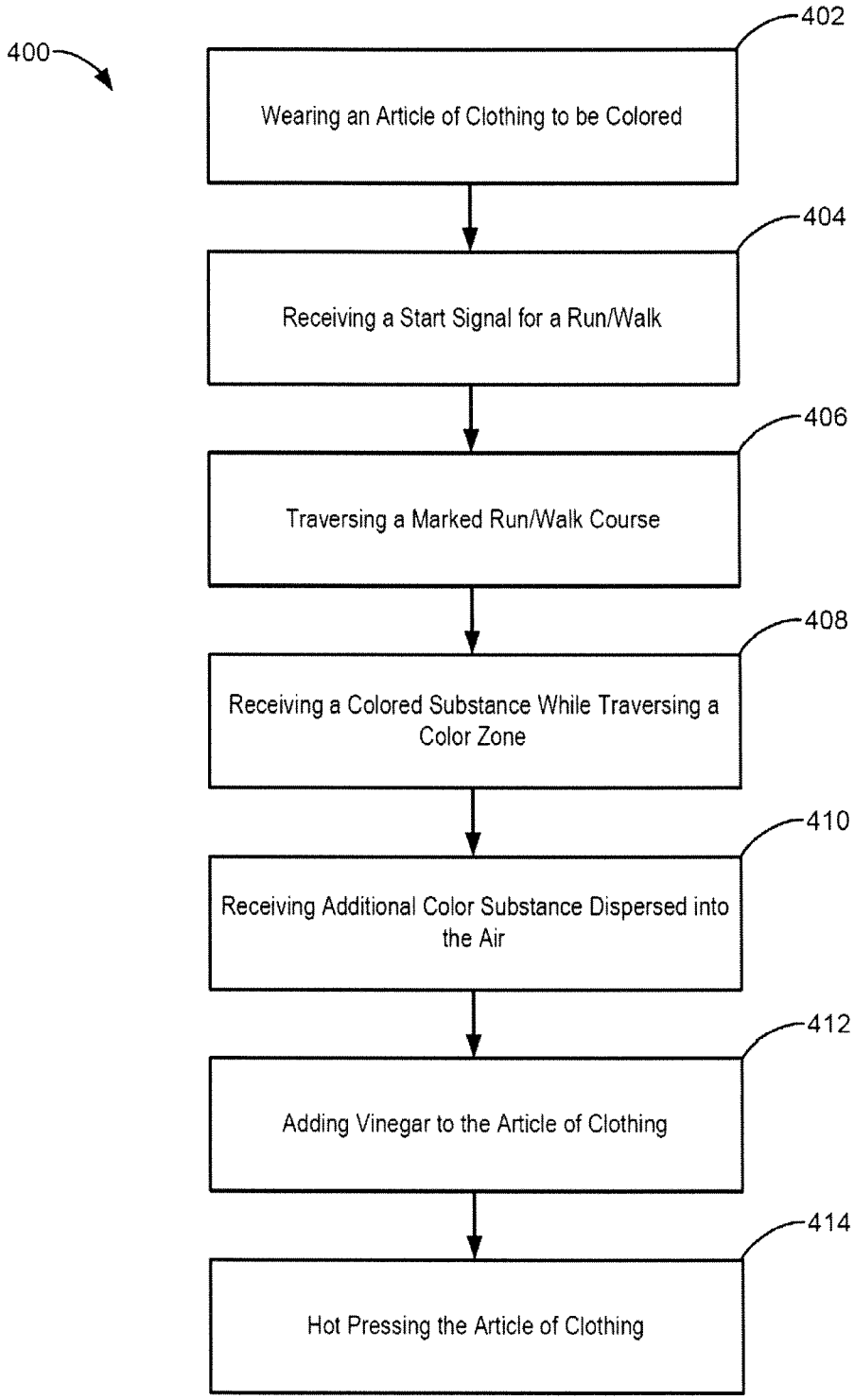
FIG. 4 is a flow diagram of a method for coloring an article of clothing.

FIG. 4 is a flow diagram of a method 400 for coloring an article of clothing 210. A plurality of participants may wish to color the article of clothing 210 by traversing the course 100. The plurality of participants may register with a run/walk organizer prior to the run/walk. Each participant may be assigned a corresponding bib number. A bib with the corresponding bib number may be distributed to each participant before, during, and/or after the marking 302, 304 of the course 100 and the color zones 120, 130, 140, 150. The bib may ensure that each participant has registered to participate in the race and may prevent participation by free riders. The first participant 200, for example, may wear 402 an article of clothing 210 that the first participant 200 wishes to have colored and/or the first participant's bib during the run/walk. The article of clothing 210 may include a t-shirt, a tank top, shorts, knee socks, shoes, a hat, sunglasses, a bandana, a sweatshirt, pants, a wristband, a headband, and/or the like. The article of clothing 210 may be distributed to the first participant 200 by the organizer when the first participant 200 registers and/or may include a logo and/or name of the organizer.

The first participant 200 may travel to a course start area before a start time, such as a group-specific start time and/or a general start time, and may find a position from which the run/walk course can be accessed. At the course start area, the first participant 200 may receive 404 a start signal, such as an audible and/or visible signal, at or near the start time. The first participant 200 may travel to and cross the start line 110 to enter the run/walk course 100.

The first participant 200 may traverse 406 the marked run/walk course 100. Traversing 406 the marked run/walk course 100 may include running; walking; riding a wheel chair, stroller, or the like; crawling; a combination of the aforementioned; and/or the like. Markings and/or barriers may indicate the run/walk course 100 to the first participant 200 so that the first participant 200 does not deviate from the run/walk course.

As the first participant 200 traverses 406 the marked run/walk course 100, the first participant may traverse each color zone 120, 130, 140, 150. The first participant 200 may receive 408 the colored substance while traversing each color zone 120, 130, 140, 150. The first participant 200 may present the article of clothing 210 and/or an area of the article of clothing 210 to the color disperser 250 to receive the colored substance. For example, the color disperser 250 may target the presented area of the article of clothing 210 when propelling the colored substance. The colored substance may remain on the article of clothing 210 after impacting it to leave one or more visible markings 212.

The first participant 200 may continue traversing the run/walk course until crossing the finish line 160. The first participant 200 may go to a congregation area after finishing the run/walk. At the congregation area, the first participant 200 may receive 410 additional colored substance dispersed into the air. The first participant 200 and/or other participants may disperse the additional colored substance into the air, such as by throwing the additional colored substance up into area. The first participant 200 may then receive 410 the colored substance as it falls from the air.

The colored substance may be only temporarily adhered to the article of clothing 210. Accordingly, the first participant 200 may process the article of clothing 210 to preserve the visible markings 212. The first participant 200 may add 412 vinegar to the article of clothing 210, such as by spraying, sprinkling, coating, and/or soaking the article of clothing 210 with the vinegar and/or the like. The first participant 200 may add 412 the vinegar at the course finish area and/or the first participant 200 may take the article of clothing 210 to another location, such as their residence.

After adding 412 the vinegar, the first participant 200 may hot press 414 the article of clothing 210 and/or a portion of the article of clothing 210, such as with an iron, a heat press, and/or the like. The article of clothing 210 may more durably retain the visible markings 212 after being processed according to steps 412 and 414. Alternatively or in addition, the first participant 200 may remove some or all of the visible markings 212 from the article of clothing 210 by blowing air across the article of clothing 210. Blowers at or near the course finish area may be used to propel the air across the article of clothing 210 and remove the visible markings 212 by blowing the colored substance off the article of clothing. The blowers may deliver a narrow targeted stream of air and/or a wide blast of air to remove the colored substance.

While specific embodiments and applications of the disclosure have been illustrated and described, it is to be understood that the disclosure is not limited to the precise configuration and components disclosed herein. Various modifications, changes, and variations apparent to those of skill in the art may be made in the arrangement, operation, and details of the methods and systems of the disclosure without departing from the spirit and scope of the disclosure. The scope of the present disclosure should, therefore, be determined only by the following claims.

The invention claimed is:

1. A method for conducting a run/walk among a plurality of participants with visible progress marking, the method comprising:

marking a run/walk course including marking one or more color zones along the run/walk course;

signaling a start to the run/walk; and propelling a first quantity of a colored substance at a first participant while the first participant traverses a first of the one or more color zones, wherein propelling the first quantity of the colored substance comprises propelling the first quantity of the colored substance at an article of clothing worn by the first participant.

2. The method of claim 1, wherein the first quantity of the colored substance is a first color.

3. The method of claim 2, wherein the first color zone is associated with the first color.

4. The method of claim 3, wherein marking the one or more color zones comprises marking the first color zone with a plurality of identically colored banners, each identically colored banner including the first color.

5. The method of claim 1, wherein marking the run/walk course comprises placing an indication of a start line at a course start area and an indication of a finish line at a course finish area.

6. The method of claim 1, wherein signaling a start to the run/walk comprises emitting a first audible signal.

7. The method of claim 1, wherein propelling the first quantity of the colored substance comprises throwing the first quantity of the colored substance.

8. The method of claim 1, further comprising signaling at regular intervals to a plurality of finished participants that additional quantities of the colored substance should be dispersed into the air.

9. A method for marking a participant in a paint race to indicate that the participant has completed a race segment, the method comprising:

marking a color zone at an end of the race segment; and propelling a quantity of a colored substance at the participant while the participant traverses the color zone, wherein propelling the quantity of the colored substance comprises propelling the quantity of the colored substance at an article of clothing worn by the participant.

10. The method of claim 9, wherein the quantity of the colored substance comprises a color.

11. The method of claim 10, wherein the color zone is associated with the color.

12. The method of claim 11, wherein marking the color zone comprises marking the color zone with a plurality of identically colored banners, each identically colored banner including the color.

13. The method of claim 9, wherein marking the color zone comprises marking a color start area.

14. The method of claim 9, wherein propelling the quantity of the colored substance comprises throwing the quantity of the colored substance.

15. The method of claim 9, wherein a course distance of the race segment substantially equals one kilometer.

16. The method of claim 9, further comprising playing music within an audible distance of the color zone.

17. A method for coloring an article of clothing, the method comprising:

wearing an article of clothing to be colored;

receiving a start signal;

traversing a course including traversing through one or more color zones on the course; and receiving a first propelled quantity of a colored substance while traversing a first of the one or more color zones, wherein the first propelled quantity of the colored substance is propelled at the article of clothing.

18. The method of claim 17, wherein the first propelled quantity of the colored substance is a first color.

19. The method of claim 18, wherein the first color zone is associated with the first color.

20. The method of claim 19, wherein the first color zone is marked by a plurality of identically colored banners, each identically colored banner including the first color.

21. The method of claim 17, wherein traversing the course comprises beginning to traverse the course after receiving the start signal.

22. The method of claim 17, wherein receiving the first propelled quantity of the colored substance comprises receiving a first thrown quantity of the colored substance.

23. The method of claim 17, further comprising receiving additional quantities of the colored substance dispersed into the air at regular intervals.

24. The method of claim 17, wherein traversing the course comprises traversing a course distance substantially equal to five kilometers.

* * * * *